US009528307B2

(12) United States Patent
Rohner et al.

(10) Patent No.: US 9,528,307 B2
(45) Date of Patent: Dec. 27, 2016

(54) HINGE FOR A FURNITURE PART AND ITEM OF FURNITURE

(71) Applicant: Grass GmbH & Co. KG, Reinheim (DE)

(72) Inventors: Mathias Rohner, Reinheim (DE); Boris Kruedener, Darmstadt (DE)

(73) Assignee: Grass GmbH & Co. KG, Reinheim (DE)

( * ) Notice: Subject to any disclaimer, the term of this patent is extended or adjusted under 35 U.S.C. 154(b) by 0 days.

(21) Appl. No.: 14/506,948

(22) Filed: Oct. 6, 2014

(65) Prior Publication Data

US 2015/0096147 A1 Apr. 9, 2015

(30) Foreign Application Priority Data

Oct. 7, 2013 (DE) ..... 20 2013 008 777 U

(51) Int. Cl.
*E05D 3/12* (2006.01)
*E05F 5/00* (2006.01)
*E05D 11/10* (2006.01)

(52) U.S. Cl.
CPC ..... *E05D 3/12* (2013.01); *E05D 11/10* (2013.01); *E05F 5/006* (2013.01); *E05Y 2201/21* (2013.01);
(Continued)

(58) Field of Classification Search
CPC ..... E05D 3/12; E05D 3/14; E05D 3/142; E05D 3/16; E05D 3/18; E05D 3/183; E05D 3/186; Y10T 16/53832; Y10T 16/53833; Y10T 16/53864;Y10T 16/547; Y10T 16/5474; Y10T 16/5475; Y10T 16/5476
See application file for complete search history.

(56) References Cited

U.S. PATENT DOCUMENTS 4,590,641 A * 5/1986 Lautenschlager ..... E05D 3/16 16/238
4,817,241 A * 4/1989 Koch ..... E05D 3/16 16/238
(Continued)

FOREIGN PATENT DOCUMENTS

DE 10 2010 006 816 A1 8/2011
WO 2012/136045 A1 10/2012
WO 2014/118320 A1 8/2014

OTHER PUBLICATIONS

German Search Report (Application No. 20 2013 008 777.3) dated Jan. 22, 2014.
(Continued)

*Primary Examiner* — Jeffrey O Brien
(74) *Attorney, Agent, or Firm* — Burr & Brown, PLLC

(57) ABSTRACT

A hinge for a movable furniture part which is accommodatable on a furniture body of an item of furniture, wherein the hinge displays a first attachment part which, via an articulation mechanism, is pivotably connected to a second attachment part, wherein the articulation mechanism comprises articulation levers, and wherein a further lever which acts on a damper assembly of the hinge and which is pivotably accommodated by way of a separate axle, and, in the case of a pivoting movement according to the intended use of the hinge, is temporarily engaged on a guide portion on the hinge, wherein the further lever, prior to an engaging operation, assumes a predetermined ready position from which the further lever engages on the guide portion.

11 Claims, 5 Drawing Sheets

(52) U.S. Cl.
CPC ..... *E05Y 2201/214* (2013.01); *E05Y 2201/264* (2013.01); *E05Y 2900/20* (2013.01); *Y10T 16/529* (2015.01)

(56) References Cited

U.S. PATENT DOCUMENTS 4,914,782 A * 4/1990 Rupprechter ..... E05D 3/16 16/319
5,035,026 A * 7/1991 Carlo ..... E05D 3/16 16/288
5,058,238 A * 10/1991 Lautenschlager ..... E05D 3/16 16/278
5,450,655 A * 9/1995 Ferrari ..... E05D 3/16 16/368
5,898,977 A * 5/1999 Muir ..... E05D 15/44 16/341
6,243,918 B1 * 6/2001 Zetti ..... E05D 3/16 16/293
6,397,836 B1 * 6/2002 Pelletier ..... E05F 1/1276 126/194
6,892,424 B1 * 5/2005 Habegger ..... E05F 1/1276 126/194
6,986,187 B2 * 1/2006 Cummins ..... E05F 1/1276 126/194
7,017,232 B1 * 3/2006 Priddy ..... E05F 1/1276 16/286
7,096,535 B2 * 8/2006 Lin ..... E05D 11/1021 16/286
7,100,241 B2 * 9/2006 Zetti ..... E05D 3/16 16/283
7,134,169 B2 * 11/2006 Habegger ..... E05D 7/123 126/191
7,406,749 B2 * 8/2008 Herper ..... E05F 5/006 16/286
7,574,775 B2 * 8/2009 Zetti ..... E05D 3/16 16/266
7,721,388 B2 * 5/2010 Lee ..... E05F 1/1276 16/286
8,677,565 B2 * 3/2014 Vanini ..... A47L 15/4261 16/286
8,683,653 B2 * 4/2014 Bettinzoli ..... E05F 1/1261 16/286
8,713,760 B2 * 5/2014 Krudener ..... E05D 3/16 16/370
8,806,718 B2 * 8/2014 Elkasevic ..... E05F 1/1261 16/286
2003/0056328 A1 * 3/2003 Habegger ..... E05F 1/1276 16/343
2005/0015927 A1 * 1/2005 Kropf ..... E05D 3/142 16/286
2005/0155180 A1 * 7/2005 Lin ..... E05D 11/1021 16/287
2005/0177980 A1 * 8/2005 Herper ..... E05F 5/006 16/366
2007/0209654 A1 * 9/2007 Wang ..... E05F 1/1276 126/194
2007/0220705 A1 * 9/2007 Fitz ..... E05F 5/006 16/54
2007/0251058 A1 * 11/2007 Fitz ..... E05D 3/16 16/287
2007/0283532 A1 * 12/2007 Vanini ..... E05F 5/10 16/277
2008/0115322 A1 * 5/2008 Migli ..... E05D 15/46 16/283
2008/0172834 A1 * 7/2008 Sutterlutti ..... E05D 3/142 16/286
2008/0201907 A1 * 8/2008 Vanini ..... E05F 1/1261 16/342
2008/0289144 A1 * 11/2008 Vanini ..... E05F 1/1261 16/221
2010/0212112 A1 * 8/2010 Steurer ..... E05F 1/1261 16/286
2010/0236021 A1 * 9/2010 Sir Louis ..... E05F 1/1261 16/303
2010/0257698 A1 * 10/2010 Vanini ..... E05F 1/1261 16/233
2010/0281650 A1 * 11/2010 Kleemann ..... A47L 15/4261 16/64
2011/0017191 A1 * 1/2011 White ..... E05F 1/1261 126/198
2011/0072617 A1 * 3/2011 Lin ..... E05F 5/006 16/298
2011/0146654 A1 * 6/2011 Basavalingappa Mudbasal ..... E05F 1/1261 126/194
2011/0146655 A1 * 6/2011 Basavalingappa Mudbasal ..... E05F 1/1261 126/194
2012/0067333 A1 * 3/2012 Mirshekari ..... E05F 1/1041 126/192
2013/0019713 A1 * 1/2013 Krudener ..... E05D 3/16 74/99 R
2013/0300274 A1 * 11/2013 Elkasevic ..... E05F 5/08 312/327
2013/0312222 A1 * 11/2013 Elkasevic ..... E05F 1/1261 16/327
2014/0130302 A1 * 5/2014 Bettinzoli ..... E05F 5/02 16/304
2014/0345082 A1 * 11/2014 Collene ..... E05F 1/1058 16/58

OTHER PUBLICATIONS

Extended European Search Report (Application No. 14187250.7) dated Feb. 12, 2015.

* cited by examiner

HINGE FOR A FURNITURE PART AND ITEM OF FURNITURE

This application claims the benefit under 35 USC §119 (a)-(d) of German Application No. 20 2013 008 777.3 filed Oct. 7, 2013, the entirety of which is incorporated herein by reference.

FIELD OF THE INVENTION

The invention relates to a hinge for a furniture part and item of furniture.

BACKGROUND OF THE INVENTION

In the furniture sector, hinges for the pivotable mounting of furniture parts on a furniture body are known. The hinges may comprise an attachment part or hinge part, respectively, which is installable on the furniture body, and a hinge part which is fixable on the movable furniture part. Using the attachment parts which are pivotable in relation to one another, furniture parts, such as, for example, a door leaf or a flap can be moved via an articulation mechanism which is provided with the hinge.

In the case of what are referred to as double-link hinges or four-bar hinges, two articulation levers or articulation arms are present on the hinge, for example.

The known hinge 1 shown in FIGS. 1 to 5 is configured as what is referred to as a wide-angle hinge or knuckle-joint hinge. The hinge 1 comprises a furniture-body hinge part 2 which is installable on a furniture body K of a furniture part, and a door-leaf attachment part or a hinge pot or a movable furniture-part hinge part 3, which is installable on a furniture part M, such as, for example, a door leaf or a flap, which, by way of the hinge 1, is movably accommodated on the furniture body. The furniture body K and the furniture part M are indicated in a purely schematic manner as a detail in FIG. 3*a*. The hinge parts 2 and 3 can in each case be fastened on the inside on the furniture body or on the movable furniture part, in particular, by way of screws or by way of rapid fastening means, in particular in a tool-free manner. The two hinge parts 2 and 3 are connected to one another in a pivotable manner in relation to one another by way of four articulation arms 4 to 7 to one another via an articulation mechanism. The articulation arms comprise a first cross arm 4 and a second cross arm 5, and a first connection arm 6 and a second connection arm 7. The articulation mechanism here displays seven pivoting articulations 8 to 14, which in the following are identified as a first to sixth articulation and as a knuckle joint. The first articulation 8 serves for pivotably receiving the first connection arm 6 on the furniture-body hinge part 2, wherein the connection arm 6, by way of a second articulation 9, is connected to the first cross arm 4 which in turn is accommodated in an articulated manner on the furniture-part hinge part 3 by way of a third articulation 10. Moreover, the second connection arm 7 is accommodated on the furniture-part hinge part 3 by way of a fourth articulation 11 and connected in an articulated manner to the second cross arm 5 by way of a fifth articulation 12. Moreover, the second cross arm 5 is accommodated in an articulated manner on the furniture-body hinge part 2 by way of a sixth articulation 13 on the furniture-body hinge part 2. Furthermore, the two cross arms 4, 5 are connected to one another in an articulated manner by way of a knuckle joint 14. All articulation axles of the articulations 8 to 14 are parallel or perpendicular to the section plane of FIGS. 3*a*, 4*a*.

By way of the articulation mechanism provided by the hinge 1, the movable furniture part M, in the mounted state on the item of furniture, may therewith be brought out of its closed position in relation to the furniture body K or the terminal position of the hinge 1, respectively, according to FIG. 4*a*, into a opened position of the furniture part which is pivoted to the maximum or into the terminal position of the hinge 1, according to FIG. 2, which corresponds to a maximum pivoting angle of more than 160 angular degrees. Therefore, the hinge 1 is also identified as a wide-angle hinge.

As shown in FIG. 5, the articulations 8 to 14, for their articulated function, are in each case implemented having one axle pin 8*a* to 14*a* which are accommodated in correspondingly matched openings or borings in the components which are connected to one another.

It is furthermore evident from FIG. 5 that the furniture-body hinge part 2 comprises an inner mounting part 15 and a capping part 16 which is placeable thereon or thereabove. The furniture-body hinge part 2 moreover comprises readjustment means for adjusting the mounted hinge 1, which comprise an adjustment screw 17 and a readjustment element 18. Moreover, in the mounting part 15, a separately insertable damper 19, which is configured as a fluid-type damper, for example, of a damper assembly which is adjustable or readjustable in its damper characteristics, is integrated. The damper 19 comprises a housing 19*a* in which a plunger, which is not evident and to which a plunger rod 19*b* protruding from the housing 19*a* is connected, is accommodated. On the outside, an operating bracket 20 is connected to the housing 19*a* by way of clamping jaws 20*a*. The plunger rod 19*b* is connected to the lower end of the adjustment screw 17.

A connecting pin 21 serves to connect the mounting part 15 and the capping part 16.

For acting on the damper 19 in a targeted manner, a control system is provided, which comprises an operating lever 22 that is connected to the housing 19*a* and which, by way of a boring 23 in the operating lever 22, a boring 25 in the capping part 16, and an axle pin 24 that engages through the borings 23 and 25, is pivotably mounted on the capping part 16, having a pivoting axle which runs parallel to the articulation axles 8 to 14. For coupling the movements of the pivoting movement of the operating lever 22 with the translatory movement of the housing 19*a*, the operating lever 22 is configured as a two-armed lever. The operating lever 22, on its end which faces the capping part 16, by way of an axle pin 26, is connected in an articulated manner by way of a further boring 28 on the end side of the operating lever 22 and a boring 27 in the operating bracket 20 to the operating bracket 20. On the end facing away from the capping part 16, the operating lever 22 is provided with a meshing portion in the form of a profile feature, here in the form of a nose 29 which projects laterally in relation to the longitudinal extent and which temporarily or in a phase-wise manner, respectively, interacts or is engageable and disengageable with a guide portion 30 on a guide lever 31.

The guide portion 30 in the guide lever 31 comprises a groove 30*a* which runs in a slightly curved manner, which is evident in particular according to FIGS. 3*b* and 4*b* in the centric longitudinal section through the guide lever 31, having a groove depth which corresponds to approximately the height of the projecting nose 29. The groove 30*a* terminates in a closed manner in the guide lever 31, wherein for the reliable and jolt-free engaging and disengaging of the nose 29 with the guide portion 30, the groove 30*a* on its open end widens by way of a flaring or funnel-shaped, when viewed from the side, threading portion 30*b*. For a clean threading-out and threading-in or for gliding in the groove 30*a*, the nose, in its section, is correspondingly designed so as to be convex on one half side and so as to be flat on one half side.

Instead of the guide groove, a slot hole which is open on the end side, a notch, a gate guide, etc. may be configured.

The guide lever 31 on the end includes in each case borings 31*a*, 31*b*, by way of which the guide lever 31 is clamped between the axle pins 13*a* and 14*a* or the corresponding articulations 13 and 14. The guide lever 31 is therewith conjointly moved in a corresponding manner to the part of the second cross arm 5 which is moved in the pivoting operation with the hinge 1. This also becomes clear from FIGS. 3*a* and 4*a*, according to which the guide lever 31 in FIG. 3*a*, in a corresponding manner to the shown intermediate position, in its longitudinal orientation is approximately perpendicular in relation to the longitudinal extent of the furniture-body hinge part 2 and, in FIG. 4*a*, in a terminal position of the pivoting mechanism is inclined with the hinge 1 toward the right by something 45 angular degrees. These positions correspond to the respective associated pivoted positions of the second cross arm 5.

In principle, the guide portion or the guide lever 31, respectively, and the further lever or the operating lever 22, may be present on another location in the hinge 1 or in other hinges.

The hinge 1 also includes a draw-in assembly 32, which is integrated in the first cross arm 4 and which, on a last part-portion of the pivoting movement, prior to attaining a closed position according to FIG. 4*a*, by way of two integrated helical springs 33, 34, and a pressure plate 35, when attaining a predefinable pivoted position of the hinge 1, pushes or draws in a self-acting manner the hinge 1 into the closed terminal position according to FIG. 4*a*, wherein the closing force required therefor is realized by way of the two pre-loaded helical springs 33, 34. The helical springs 33, 34, after a blocking of the draw-in assembly 32 is neutralized, which takes place, for example, when closing a furniture part M on a furniture body K, with the hinge 1 at a predefinable pivoting point, here act on the pressure plate 35 such that the pressure plate 35 is displaced in the direction of the connection arm 6 and acts on the latter such that a damped closing of the furniture part M into the terminal position according to FIG. 4*a* takes place. Shortly after activating the draw-in assembly 32, in a further closing movement, the damper assembly 19 is likewise activated thereafter by way of coupling the activating lever 22 to the guide lever 31, on the one hand, and to the operating bracket 20, on the other hand.

The draw-in assembly 32 is held on the cross arm 4 by way of two cotter pins 36, 37.

When re-opening the movable furniture part M attached on the furniture-part hinge part 3 in relation to the furniture body K, the draw-in assembly 32 is brought into its pre-loaded position again (FIGS. 1, 2, 3*a*) and held therein until the predefined draw-in position is attained again in a return movement by way of pivoting the hinge 1 when closing the respective furniture part. The damper assembly 19 is correspondingly brought back into the ready position according to FIGS. 1, 2 and 3*a*, respectively, by sliding the housing 19*a* back into the ready position by action of the activating lever 22 which correspondingly pivots back when opening the furniture part M.

In this manner, despite the automatic draw-in or slamming, no shock-like striking of the furniture part M on the furniture body K can take place in the case of the pivoting operation when closing the furniture part M. When damping the closing movement, the housing 19*a* is moved in the direction of a forward end of the plunger rod 19*b* which projects from the housing 19*a* and is held in a positionally fixed manner. This movement takes place in a damped or braked manner, respectively.

During the damping operation, the operating lever 22 is pivoted in the clockwise direction about the axle pin 24 in the boring 25, according to the arrow P1 in FIG. 3*b*, such that the housing 19*a* is displaced in relation to the free end of the plunger rod 19*b*, according to the arrow P2 in FIG. 3*a*. When coupling, the nose 29, on the front of the operating lever 22, is brought up to the terminal position according to FIGS. 4*a* and 4*b* in the guide portion 30. When re-opening or re-pivoting, respectively, in the opposite direction, the damper housing 19*a*, on account of the interaction of the guide lever 31 and of the operating lever 22, is displaced back into the shown ready position according to FIG. 3*a*.

SUMMARY OF THE INVENTION

It is an object of the present invention to design the above-mentioned assemblies in a compact manner, so as to have extended functionality. In particular, misalignments of hinge parts that arise during the operation of the hinge should be self-rectifying.

The present invention is based on a hinge for a movable furniture part which is accommodatable via the hinge on a furniture body of an item of furniture, in particular, a furniture hinge for a door or flap, wherein the hinge displays a first attachment part which is installable on the furniture body and which, via an articulation mechanism, is pivotably connected to a second attachment part which is installable on the movable furniture part, wherein the articulation mechanism comprises articulation levers which are mounted by way of articulation axles, and wherein a further lever which acts on a damper assembly of the hinge and which is pivotably accommodated by way of an axle separate to the articulation axles and, in the case of a pivoting movement according to the intended use of the hinge, is temporarily engaged on a guide portion on the hinge, wherein, in the usual operation of the hinge, the further lever, prior to an engaging operation, assumes a predetermined ready position from which the further lever engages on the guide portion.

The core of the present invention is that a setting portion which is tuned to the further lever is configured in such a manner that the further lever on the hinge, from a pivoted position which, prior to the engaging operation, is different from the predetermined ready position, interacts with the setting portion in the case of the pivoting movement according to the intended use of the hinge such that the setting portion forces the further lever into the engaged state. The further lever is thus also placeable in a functionally correct manner on the hinge into the engaged state on the guide portion of the hinge by way of the setting portion when the further lever is in the non-regulating positions. By way of the invention, self-healing of an undesirable misalignment or an exceptional position, which cannot be entirely excluded, of the hinge or the further lever, respectively, is advantageously provided without any particular measure or in a manner which is not perceivable to the user.

When opening the movable furniture part and thus the hinge, it may happen that the further lever assumes a misalignment which does not correspond to the defined ready position. This may be the case, for example, in an opening operation of the movable furniture part which is too fast or too severe, having loading peaks which briefly act on the hinge. Without an assembly or setting portion, according to the present invention, a malfunction of the hinge would arise, since the further lever and the guide portion would not be able to interact according to the intended use. Without the setting portion according to the present invention, the further lever and the guide portion, in particular, would move past one another in the event of a closing movement of the movable furniture part, thus making available only a limited functionality of the hinge. This situation is avoided by the invention.

The present invention is particularly advantageous with respect to the functioning of the damper assembly. Accordingly, the further pivotably mounted lever, in the case of a complete pivoting movement according to the intended use of the hinge, is temporarily engaged on a guide portion on the hinge, wherein the further lever acts on the damper assembly of the hinge. The damper assembly of the hinge, in the case of a pivoting movement according to the intended use of the hinge, in particular, serves to achieve a damped or braked movement into a terminal position of the pivoting operation executed with the hinge. In the mounted state of the hinge on the item of furniture, this allows for an undesirable heavy slamming of the movable furniture part, in particular, an unpleasant slamming noise or damage to the furniture part and to the furniture body, respectively, to be avoided.

Without the assembly according to the present invention, the damping effect in the case of a pivoted position of the further lever, which, prior to the engaging operation, is different from the predetermined ready position, would not be initiated when closing the hinge, or would not be initiated in a functionally correct manner.

In the hinge working in a functionally correct manner, the actuation of the damper assembly, in cooperation of the further lever with the guide portion, advantageously always takes place at the same location of the pivoting movement of the furniture part or at an always identical pivoted position of the hinge on its way into a terminal position of the pivoting movement possible with the hinge. The interaction of the further lever with the guide portion may be implemented in a very space-saving or compact manner, respectively. The further lever and the guide portion, in particular, may be provided in regions which are anyway vacant in the case of known corresponding hinges. These regions preferably lie in the interior of the hinge and are not or hardly visible from outside. In the case of an assembly according to the present invention, this allows for a desired visual impact or a preferred exterior design, to be realized.

Alternatively or additionally, instead of the damper assembly, the hinge may comprise an actuator, such that, in the case of a complete pivoting movement according to the intended use of the hinge, the further lever is temporarily engaged on a guide portion on the hinge, wherein the further lever acts on the actuator of the hinge. An actuator is generally to be understood to be an element which transforms an input variable into an output variable of a different type, in order to elicit a desired action or an effect. Conceivable actuator principles are, for example, inductive electric motors, hydraulic or pneumatic actuators, cylinders, electro-chemical or electro-mechanical actuators, piezo actuators.

An electric motor can be operated or activated, respectively, in particular, by way of the cooperation of the further lever with the guide portion.

With the actuator or the electric motor, respectively, a closing and/or opening movement of the movable furniture part may be influenced, for example.

Also, by way of the actuator, a locking or latching of the movable furniture part, in particular, in a closed terminal position, is conceivable.

It is not excluded, in principle, that a plurality of components, for example, a damper assembly and an actuator, may be acted on by way of the cooperation of the further lever with the guide portion.

Two or more further levers, in particular, having in each case one assigned guide portion, may also be provided on one hinge.

In the installed state of the hinge on the item of furniture, a kinematically defined reciprocating movement, the terminal positions of which is assigned to a completely closed and a completely open position of the item of furniture in relation to the furniture body, is provided with the hinge. Engaging takes place at a particular point of the pivoting movement, and disengaging of the further lever on the guide portion takes place in the later reverse movement. In this cooperation, proceeding from a terminal point after a determined proportion of the entire possible rotating or pivoting movement of the hinge, the further lever and the guide portion are brought together. For example, by meshing the two elements, their further movement then takes place in a collective or interconnected manner. In this engaging state, the lever acts on the damper assembly or the actuator.

The meshing or the engaging may take place, for example, by means of a catching or threading mechanism. To this end, the guide portion may display, for example, a gate guide for the further lever. To this end, a portion of the further lever in its shape is exactly tuned to the gate guide.

The system may also be considered to be a type of enforced control of the further lever by the guide portion. The further lever remains motionless in the non-engaged state and is pivoted in the engaging state.

It is also possible for a movement of the guide portion and of the further lever to take place until engagement, even in a mutually opposing or mutually rotating manner. When engaging, a stoppage of the movement of one of the two components may arise. In the engaged state, the entire system of guide portion and further lever continues to move in a defined manner, wherein resulting guiding in the guide portion may correspond to the velocity pole of the movement of the further lever.

Preferably, the further lever is pivotably accommodated by way of an axle separate from the articulation axles. In this way, the positioning of the further lever, which is adapted to the spatial circumstances or is variable, can take place. The further lever may be present, for example, on an attachment part in the region present between two present articulation axles.

Moreover, it is advantageous for a bearing portion of the further lever, which is engageable with the guide portion, to be present, wherein the setting portion comprises a guide edge that is tuned to the bearing portion and which is obliquely oriented in a direction of movement of the bearing portion. The setting portion is present in particular on a component or lever on which the guide portion is configured.

According to an advantageous variant, an extension of the setting portion is adapted to at least one substantial extension of the guide portion. In this way, the setting portion and the guide portion advantageously collaborate.

It is furthermore of advantage that the setting portion comprises a passage for the bearing portion, wherein the passage includes oblique faces which lie opposite one another. Preferably, the setting portion includes oblique faces which taper in the direction of the passage toward the guide portion. This also increases the functionality of the setting portion.

It is also advantageous for the further lever and the guide portion to be tuned to one another in such a manner that an engagement state between the further lever and the guide portion, which is established in the case of a pivoting movement according to the as-intended movement of the hinge into a terminal position, is neutralized in the case of a pivoting movement of the hinge out of the terminal position. The engagement of the further lever on the guide portion and the retaining of the engagement state takes place over part or a phase of the entire pivoting movement which is possible with the hinge. This phase describes a phase prior to attaining a terminal point of the pivoting movement, that is to say the engaging point, up to the associated terminal point, without a reversal of the direction of movement. Out of this terminal position and under reversal of the direction of movement, the engagement state is retained until the corresponding engaging point is attained and disengaging or decoupling takes place. Typically, disengaging is retained until the other terminal point is attained. However, further engaging in the pivoting movement in the other terminal point is not excluded.

In the case of being mounted on the item of furniture, in a reverse movement of the hinge, for example, when opening the movable furniture part in relation to the furniture body, a decoupled or uncoupled situation of the further lever and of the guide portion is attained. Here, the damper assembly or the actuator is again returned to an initial state corresponding to the one prior to the action by the lever. In the following renewed closing movement, the damper assembly or the actuator of the image is again operated.

It is furthermore proposed that the further lever is configured to act on a portion of a component which is present on the first attachment part that is installable on the furniture body. In this manner, the damper or an actuator can be housed on the attachment part which is installed on the furniture body, which is customarily advantageous for constructive reasons or space reasons.

However, it is, in principle not excluded that the damper assembly or the actuator is present on the attachment part which is accommodated on the furniture body.

The guide portion is advantageously accommodated between two articulation axles of the hinge. In particular, the guide portion may advantageously be present between a positionally fixed articulation axle on an attachment part and an articulation axle which is conjointly moved in the pivoting operation. In this way, the guide portion can be housed in a particularly space-saving manner.

It is furthermore advantageous for the guide portion to comprise a guide track that is raised or sunken in relation to adjacent regions, and which is configured so as to be tuned for the temporary engagement with a meshing portion of the further lever. The guide track is in particular designed as a guide groove or as a guide duct. For example, a projecting or raised part, such as, for example, a meshing nose can engage in the guide groove on the further lever and optionally be moved along the guide groove in the engagement state. A reversal of the shape, according to which the guide portion displays a meshing portion which meshes in a guide groove on the further lever in the engaging state, is not excluded.

It is furthermore advantageous for the guide portion to be present in such a manner that, in the case of a pivoting movement according to the as-intended movement of the hinge, the guide portion is conjointly moved. The guide portion in particular always moves when the pivoting movement takes place. In this manner, the guide portion may be provided, for example, on an articulation lever, for example, integrally therewith or as an additional part thereon.

It is furthermore advantageous for the further lever to be pivotably mounted on one of the attachment parts. The further lever is configured as a two-armed lever. In this manner, the further lever may interact with one end with the guide portion and with the other end with the damper assembly or the actuator. When viewed in the longitudinal direction, the further lever, in particular, in the region of its axle, may display a kink or a bend.

It is furthermore proposed that the further lever and the damper assembly are disposed on the same attachment part. In this manner, action on the damper by the lever may take place in the immediate proximity. Accordingly, the further lever and the actuator may be disposed on the same attachment part.

It is furthermore preferable for the hinge to be configured as a knuckle-joint hinge. Specifically, the knuckle-joint hinge may be designed so as to be particularly rugged and for various maximum angular ranges of the pivoting movement which can be bridged. The articulation mechanism of a knuckle-joint hinge in particular may comprise a first and a second cross arm and a first and a second connection lever, wherein the first connection lever is connected by way of a first articulation on the first attachment part and by way of a second articulation to the first cross arm which is accommodated by way of a third attachment-side cross-arm articulation on the second attachment part, and the second connection lever is connected by way of a fourth articulation on the second attachment part and by way of a fifth articulation to the second cross arm which is accommodated by way of a sixth attachment-side cross-arm articulation on the first attachment part, and wherein the two cross arms are connected to one another in an articulated manner by way of a knuckle joint. In the case of an articulation movement, all levers may be simultaneously pivoted about in each case one assigned articulation of the aforementioned articulations.

It is preferable that the guide portion is provided between the knuckle joint and an attachment-side cross-arm articulation and is conjointly movable according to the movement of one of the two cross arms in a pivoting movement which is executable by the hinge.

In an advantageous modification of the present invention, the hinge is configured as a wide-angle hinge. In the use state, a wide-angle hinge enables a particularly wide opening or pivoting, respectively, of the movable furniture part in relation to a closed position on the furniture body. In this manner, in particular also comparatively large pivot angles up to more than 160 angular degrees can be implemented.

The present invention moreover relates to an item of furniture having a movable furniture part which is attached on a furniture body of the item of furniture, in particular, having a door or flap, wherein the item of furniture displays a hinge according to one of the abovementioned embodiments. In this manner, the advantages already explained above can be implemented on the item of furniture.

BRIEF DESCRIPTION OF THE DRAWINGS

Further features and advantages of the invention will be explained by means of the hinges illustrated in the figures.

DETAILED DESCRIPTION OF THE INVENTION

Figure 1:
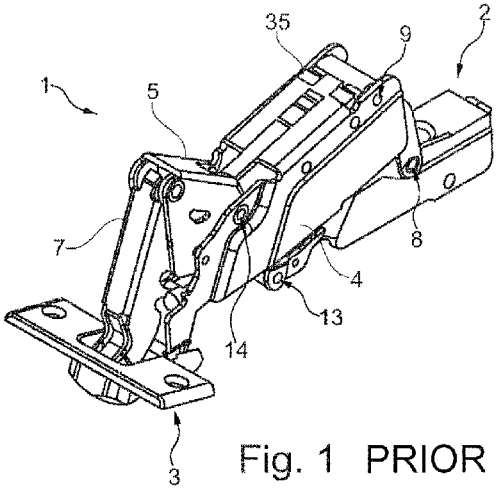
Fig. 1 PRIOR ART
FIG. 1 is a perspective view of a prior art hinge in an intermediate position of a pivoting movement which is executable with the hinge.
Figure 2:
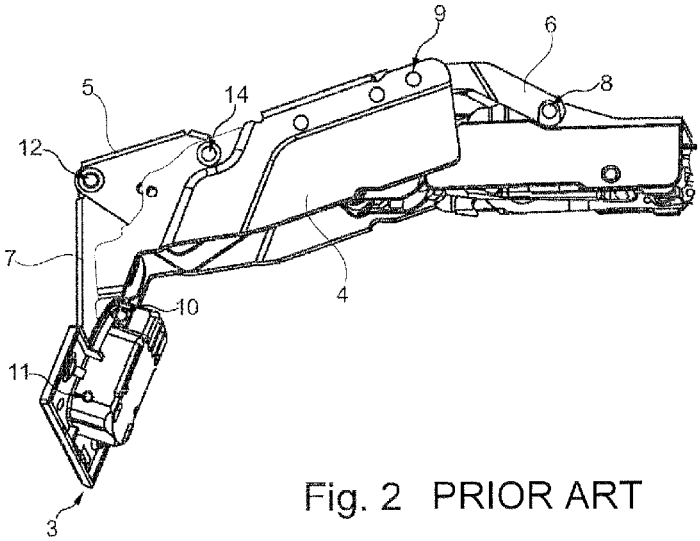
Fig. 2 PRIOR ART
FIG. 2 is a further perspective view of the hinge according to FIG. 1, in a terminal position.
Figure 3A:
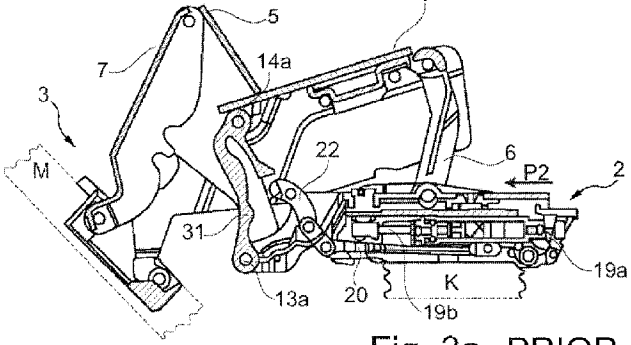
Fig. 3a PRIOR ART
FIG. 3*a* is a longitudinal sectional side view of the assembly according to FIG. 1.
Figure 3B:
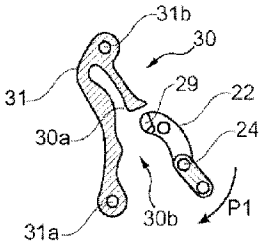
Fig. 3b PRIOR ART
FIG. 3*b* individually shows two components of the assembly according to FIG. 3*a;*
Figure 4A:
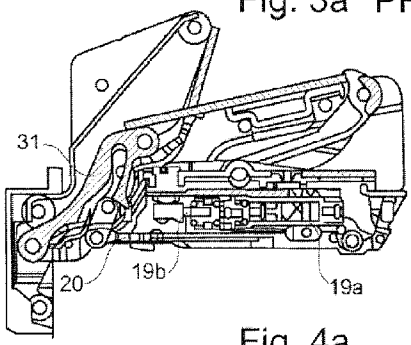
Fig. 4a PRIOR ART
FIG. 4*a* is a longitudinal sectional view showing the hinge according to FIGS. 1 to 3*a*, in a terminal position further to the terminal position according to FIG. 2.
Figure 4B:
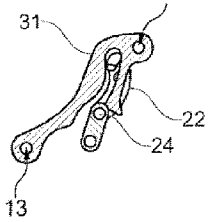
Fig. 4b PRIOR ART
FIG. 4*b* individually shows two components of the assembly according to FIG. 4*a;*
Figure 5:
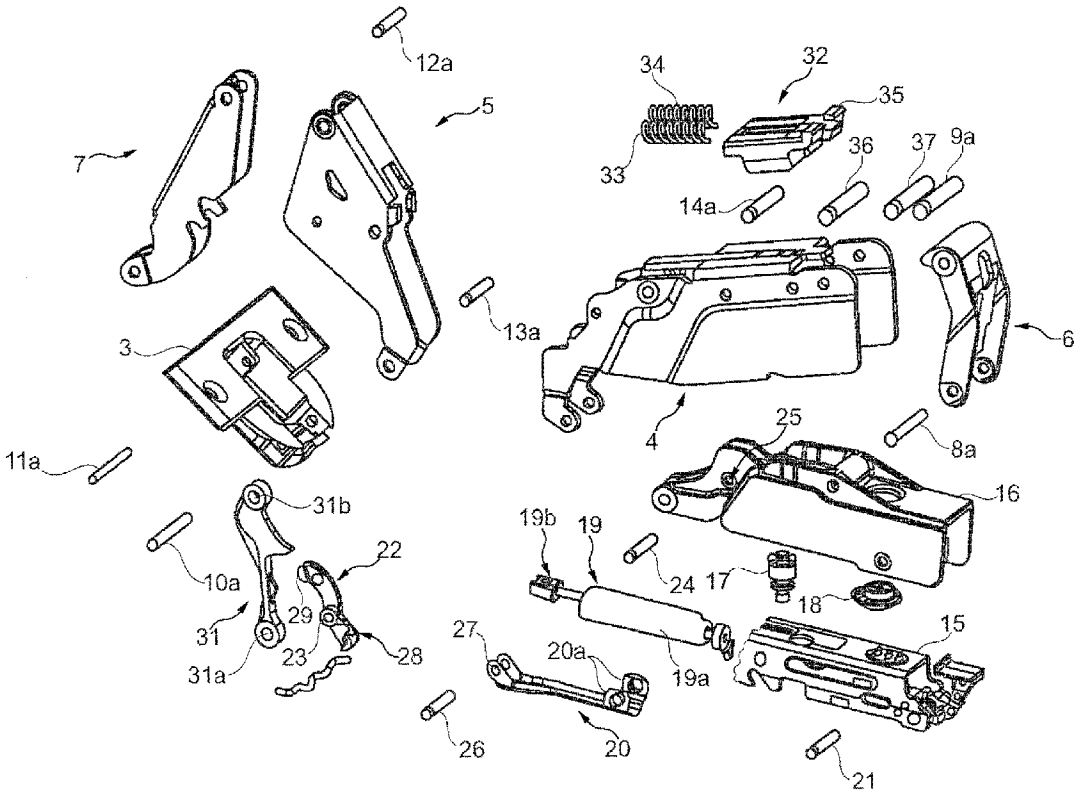
Fig. 5 PRIOR ART
FIG. 5 is an exploded view of the hinge in the intermediate position according to FIG. 1.
Figure 6:
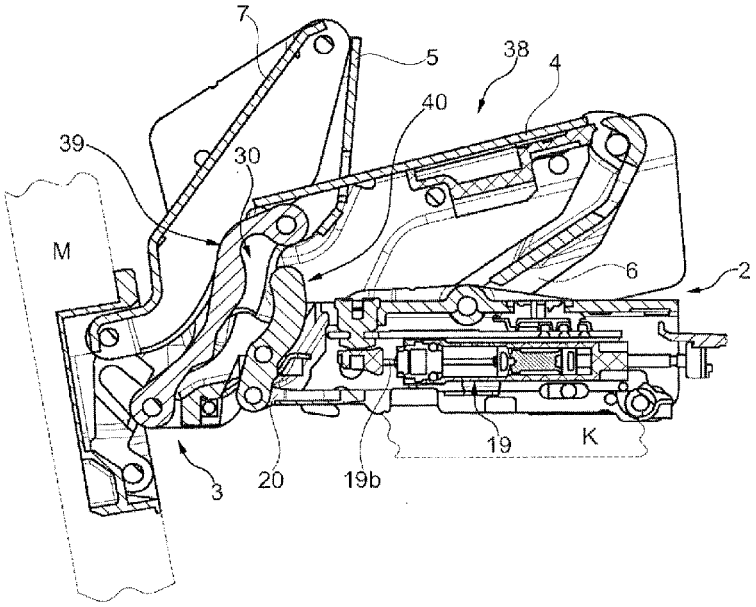
FIG. 6 is a longitudinal sectional view showing a hinge according to the present invention.
Figure 7:
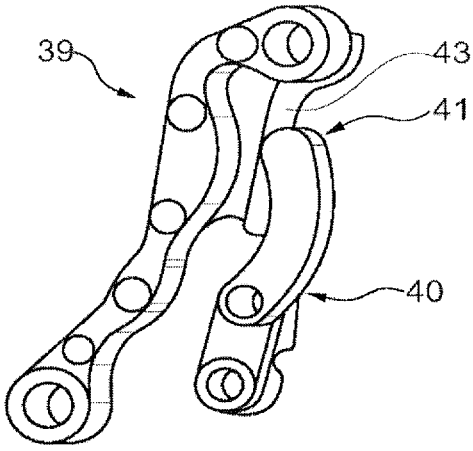
FIG. 7 is a perspective view showing two components of the assembly according to FIG. 6.
Figure 8:
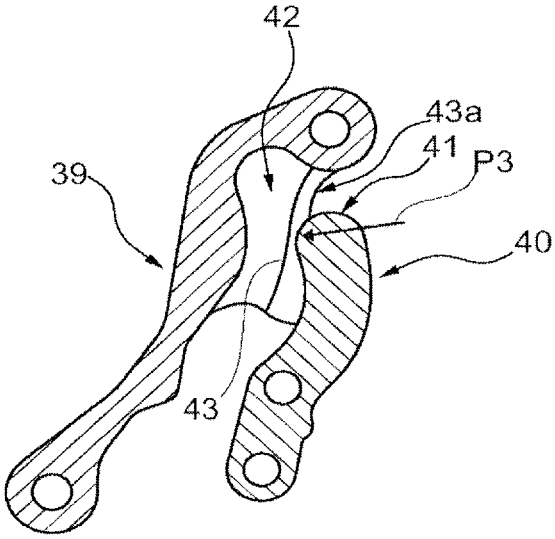
FIG. 8 is a sectional view showing the components according to FIG. 7.

In the case of the assembly according to the present invention shown in FIGS. 6-8, the same reference signs have been used in part for parts which correspond to the known assembly shown in FIGS. 1-5.

FIG. 6 shows a hinge 38 which, in relation to the hinge 1, is according to the invention and which, in its basic function, substantially corresponds according to the hinge 1 and is constructed in a corresponding manner. The hinge 38 comprises the same basic components as the hinge 1, in particular a furniture-body hinge part 2 on the furniture body K, a furniture-part hinge part 3 on the furniture part M, cross arms 4, 5, connection arms 6, 7, a damper 19 having a plunger rod 19*b*, an operating bracket 20, and a guide portion 30 on the hinge 38. In the following, the hinge 38 will be explained, in particular with respect to the differences in relation to the hinge 1.

According to FIG. 6, the hinge 38 is situated in a state close to a terminal position of the hinge 38 in the case of a closed furniture part. Here, a disengaged state of a guide lever 39 and of an operating lever 40 which interacts therewith is illustrated.

In normal operation, the guide lever 39 and the operating lever 40 function in a corresponding manner to the interaction of the guide lever 31 with the operating lever 22, according to the hinge 1, and therefore, in their basic shape, very closely resemble the guide lever 31 or the operating lever 22, or are correspondingly disposed.

For threading-in a forward end region 41 of the operating lever 40 into a gate or groove 42, respectively, on the guide lever 39, the guide lever 39 displays a guide face 43 which, by way of the longitudinal extent of the groove 42, is configured on the periphery thereof which is oriented toward the end region 41. The guide face 43 is configured such or tuned to the end region 41 which conjointly moves with the pivoting of the operating lever 40 such that in a pivoted position of the operating lever 40, according to the direction of movement P3, prior to an engaging operation of the operating lever 40 on the guide lever 39, wherein the pivoted position is different from a predefined functionally correct ready position, brings the end region 41 of the operating lever 40 and, therefore, the latter itself into the functionally correct position in relation to the guide lever 39 and further into the correct engagement position of the operating lever 40 and guide lever 39.

For a smooth or gliding interaction of the operating lever 40 and guide lever 39, the orientation or the profile and/or the shape of the guide face 43 may be configured on a corresponding counter face which interacts therewith on the end region 41 of the operating lever 40, in order to ensure a jolt-free hinge movement.

The guide face 43 may be designed on the forward periphery 43*a* in such a manner that the end region 41 of the operating lever 40 can engage without significant resistance in the groove 42 when a hinge movement of the hinge 38 takes place, in which the operating lever 40 engages on the guide lever 39. This triggers a damper 19 on the hinge 38, such that the closing movement of the movable furniture part which is not illustrated takes place in a gentle manner. FIG. 6 shows the operating lever 40 in the disengaged state from the guide lever 39 or from a gate present thereon, having the groove 42, respectively.

LIST OF REFERENCE SIGNS

1 Hinge
2 Furniture-body hinge part
3 Furniture-part hinge part
4 Cross arm
5 Cross arm
6 Connection arm
7 Connection arm
8 to 13 Articulation
8*a* to 14*a* Axle pin
14 Knuckle joint
15 Mounting part
16 Capping part
17 Adjustment screw
18 Readjustment element
19 Damper
19*a* Housing
19*b* Plunger rod
20 Operating bracket
20*a* Clamping jaw
21 Connecting pin
22 Operating lever
23 Boring
24 Axle pin
25 Boring
26 Axle pin
27 Boring
28 Boring
29 Nose
30 Guide portion
30*a* Groove
30*b* Threading-in portion
31 Guide lever
31*a*, 31*b* Boring
32 Draw-in assembly
33, 34 Helical spring
35 Pressure plate
36, 37 Cotter pin
38 Hinge
39 Guide lever
40 Operating lever
41 End region
42 Groove
43 Guide face
43*a* Periphery

The invention claimed is:

1. A hinge for a movable furniture part configured to be attached to a furniture body of a furniture item, wherein the hinge comprises:

a first attachment part configured to be attached on the furniture body; and a second attachment part configured to be attached on the movable furniture part of the furniture item, wherein the first attachment part is pivotably connected to the second attachment part via an articulation mechanism, and wherein the articulation mechanism comprises articulation levers that are mounted via articulation axles;

a guide lever extending in a longitudinal direction and having a front face, a rear face, a first leg, a guide face having a guide edge inclined from the rear face towards the front face, and a groove extending in the longitudinal direction between the first leg and the guide face; and a further lever which acts on a hinge damper assembly, the further lever is pivotally accommodated via an axle separate from the articulation axles and further comprises a bearing portion on an end opposite the axle;

wherein during a normal operation of the hinge, the further lever assumes a predetermined ready position in which the bearing portion of the further lever is aligned to engage the groove along the longitudinal direction via an opening;

wherein during an abnormal operation of the hinge in which the further lever has become misaligned with the groove and is in a position different from the predetermined ready position, the bearing portion of the further lever engages the inclined guide edge of the guide lever in a direction substantially orthogonal to the longitudinal direction such that the bearing portion slides over the inclined guide edge and engages with the groove to resume normal operation of the hinge.

2. The hinge according to claim 1, wherein the guide edge is formed with an engaging portion on a side facing the groove to prevent the bearing portion from sliding out over the guide edge during normal operation of the hinge.

3. The hinge according to claim 1, wherein the further lever is configured to act on a portion of a component of the first attachment part.

4. The hinge according to claim 1, wherein the guide lever is accommodated between two articulation axles of the hinge.

5. The hinge according to claim 1, wherein the groove of the guide lever is raised or sunken in relation to adjacent regions.

6. The hinge according to claim 1, wherein the further lever is pivotably mounted on one of the attachment parts.

7. The hinge according to claim 1, wherein the hinge is configured as a knuckle-joint hinge.

8. The hinge according to claim 1, wherein the hinge is configured as a wide-angle hinge.

9. A furniture item having a movable furniture part attached on a furniture body of the furniture item, wherein the furniture item comprises a hinge according to claim 1.

10. The furniture item according to claim 9, wherein the movable furniture part is a door.

11. The furniture item according to claim 9, wherein the movable furniture part is a flap.

* * * * *